US011642754B2

(12) United States Patent
Liu

(10) Patent No.: US 11,642,754 B2
(45) Date of Patent: May 9, 2023

(54) SLURRY RECYCLING FOR CHEMICAL MECHANICAL POLISHING SYSTEM

(71) Applicant: Taiwan Semiconductor Manufacturing Co., Ltd., Hsinchu (TW)

(72) Inventor: Wen-Kuei Liu, Hsinchu (TW)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 907 days.

(21) Appl. No.: 16/252,101

(22) Filed: Jan. 18, 2019

(65) Prior Publication Data

US 2020/0070308 A1 Mar. 5, 2020

Related U.S. Application Data

(60) Provisional application No. 62/724,910, filed on Aug. 30, 2018.

(51) Int. Cl.

| | |
|---|---|
| ***B24B 37/04*** | (2012.01) |
| ***B24B 37/26*** | (2012.01) |
| ***B24B 57/02*** | (2006.01) |
| ***B24B 53/017*** | (2012.01) |

(52) U.S. Cl.

CPC ..... *B24B 57/02* (2013.01); *B24B 37/04* (2013.01); *B24B 37/26* (2013.01); *B24B 53/017* (2013.01)

(58) Field of Classification Search

CPC ..... B24B 37/04; B24B 37/107; B24B 37/26; B24B 53/017; B24B 57/00; B24B 57/02; B24B 55/03; B01D 29/00; B01D 61/14

USPC ..... 451/446, 60

See application file for complete search history.

(56) References Cited

U.S. PATENT DOCUMENTS

| | | | | |
|---|---|---|---|---|
| 5,647,989 A * | 7/1997 | Hayashi | B24B 57/02 | 210/651 |
| 6,106,728 A * | 8/2000 | Iida | B24B 57/02 | 438/692 |
| 6,183,352 B1 * | 2/2001 | Kurisawa | B24B 57/02 | 451/36 |

(Continued)

FOREIGN PATENT DOCUMENTS

| | | |
|---|---|---|
| CN | 1469794 A | 1/2004 |
| CN | 101500754 A | 8/2009 |

(Continued)

*Primary Examiner* — Joseph J Hail
*Assistant Examiner* — Arman Milanian
(74) *Attorney, Agent, or Firm* — Sterne, Kessler, Goldstein & Fox P.L.L.C.

(57) ABSTRACT

The present disclosure describes an apparatus and a method for a chemical mechanical polishing (CMP) process that recycles used slurry as another slurry supply. The apparatus includes a pad on a rotation platen, a first feeder and a second feeder where each of the first and the second feeder is configured to dispense a slurry on the pad, and a flotation module configured to process a first fluid sprayed from the pad. The flotation module further includes an outlet fluidly connected to the second feeder and configured to output a second fluid, and a first tank configured to store a plurality of chemicals where the plurality of chemicals include a frother and a collector configured to chemically bond with chemicals in the first fluid.

20 Claims, 7 Drawing Sheets

(56) References Cited

U.S. PATENT DOCUMENTS

| | | | | |
|---|---|---|---|---|
| 6,358,125 | B2 * | 3/2002 | Kawashima | B01F 23/49 451/36 |
| 6,458,020 | B1 * | 10/2002 | Brigante | B24B 37/04 451/60 |
| 6,623,355 | B2 | 9/2003 | McClain et al. | |
| 6,866,784 | B2 * | 3/2005 | Chang | B24B 37/04 210/651 |
| 7,052,599 | B2 * | 5/2006 | Osuda | B01D 61/22 451/60 |
| 10,017,675 | B2 * | 7/2018 | Takahashi | B24B 57/02 |
| 10,441,958 | B2 | 10/2019 | Jameson | |
| 2001/0052500 | A1 * | 12/2001 | Sun | C07D 213/74 210/729 |
| 2004/0219867 | A1 * | 11/2004 | Gotkis | H01L 21/67253 451/60 |
| 2013/0140218 | A1 * | 6/2013 | Dobby | B03D 1/087 209/164 |
| 2013/0306525 | A1 * | 11/2013 | Kramer | G05B 13/04 209/168 |
| 2020/0316614 | A1 * | 10/2020 | Swensen | C10L 9/00 |

FOREIGN PATENT DOCUMENTS

| | | | |
|---|---|---|---|
| CN | 102365716 | A | 2/2012 |
| CN | 106733219 | A | 5/2017 |
| CN | 108348927 | A | 7/2018 |
| JP | 63-130154 | A | 6/1988 |
| JP | 2004-223321 | A | 8/2004 |
| JP | 2015-155132 | A | 8/2015 |
| JP | 5905191 | B2 | 4/2016 |
| WO | WO0170462 | A1 | 9/2001 |

* cited by examiner

SLURRY RECYCLING FOR CHEMICAL MECHANICAL POLISHING SYSTEM

RELATED APPLICATION

This application claims the benefit of U.S. Provisional Patent Application No. 62/724,910, filed Aug. 30, 2018, titled "Slurry Recycling for Chemical Mechanical Polishing (CMP) System," which is incorporated by reference herein in its entirety.

BACKGROUND

Polishing semiconductor wafers with a chemical mechanical planarization (CMP) system requires a continuous supply of slurry. The continuous supply of slurry contributes to a significant cost of fabricating semiconductor devices.

BRIEF DESCRIPTION OF THE DRAWINGS

Aspects of the present disclosure are best understood from the following detailed description when read with the accompanying figures. It is noted that, in accordance with common practice in the industry, various features are not drawn to scale. In fact, the dimensions of the various features may be arbitrarily increased or reduced for clarity of discussion.

DETAILED DESCRIPTION

Figure 1:
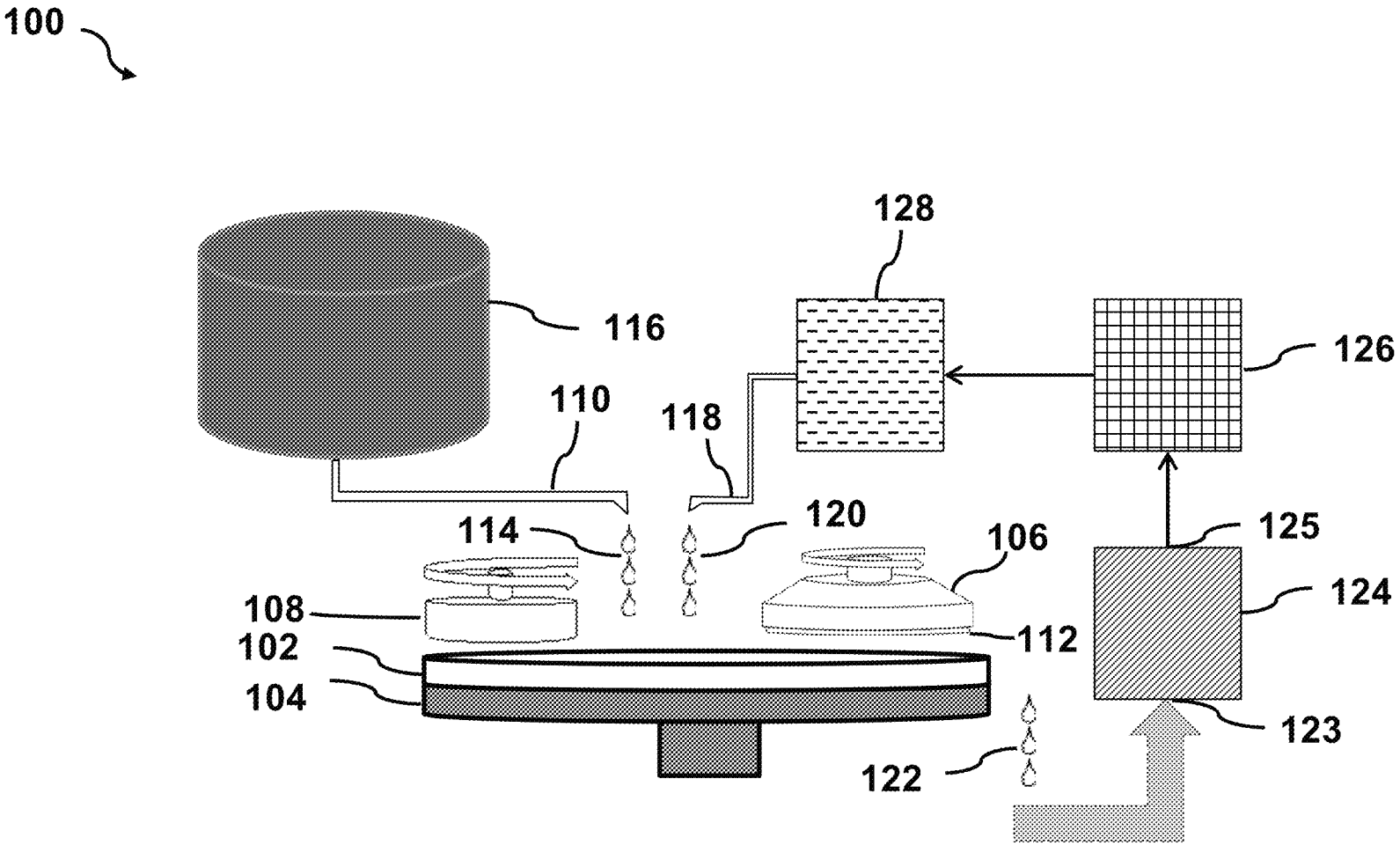
FIG. 1 illustrates a CMP system, according to some embodiments.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over a second feature in the description that follows may include embodiments in which the first and second features are formed in direct contact, and may also include embodiments in which additional features may be formed that are between the first and second features, such that the first and second features are not in direct contact.

Further, spatially relative terms, such as "beneath," "below," "lower," "above," "upper," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

The term "about" as used herein indicates the value of a given quantity that can vary based on a particular technology node associated with the subject semiconductor device. In some embodiments, based on the particular technology node, the term "about" can indicate a value of a given quantity that varies within, for example, 5-30% of the value (e.g., ±5%, +10%, ±20%, or ±30% of the value).

Chemical mechanical planarization (CMP) is a planarization technique that can be used to planarize a wafer's surface by a relative motion between a wafer and a polishing pad in the presence of a slurry while applying pressure (e.g., a downforce) to the wafer. The slurry and the polishing pad are referred to as "consumables" because of their continual usage and replacement. For ease of reference, the CMP system is also referred to herein as a "polisher."

In the polisher, the wafer is positioned face down on a wafer holder, or carrier, and held against a polishing pad which is positioned on a flat surface referred to as a "platen." The polisher can use either a rotary or orbital motion during the polishing process. The CMP process achieves wafer planarity by removing elevated features relative to recessed features on the wafer surface.

The slurry is a mixture of abrasives and chemicals that are used to remove specific materials from the wafer's surface during the CMP process. Precise slurry mixing and consistent batch blends are critical for achieving wafer-to-wafer (WtW) and lot-to-lot (LtL) polishing repeatability (e.g., consistent polish rate, consistent polish uniformity across the wafer and across the die, etc.). The quality of the slurry is important so that scratches on the wafer surface are avoided during the CMP process.

The polishing pad attaches to a top surface of the platen. The polishing pad can be made, for example, from polyurethane due to polyurethane's mechanical characteristics and porosity. Further, the polishing pad can include small perforations to help transport the slurry along the wafer's surface and promote uniform polishing. The polishing pad also removes the reacted products away from the wafer surface. As the polishing pad polishes more wafers, the pad's surface becomes flat and smooth, causing a condition referred to as "glazing." Glazed pads cannot hold the polishing slurry-which significantly decreases the polishing rate.

Polishing pads require regular conditioning to retard the effects of glazing. The purpose of conditioning is to remove old slurry particles and abraded particles from the polishing pad to extend the polishing pad's lifetime and provide consistent polishing performance throughout its life. Polishing pads can be conditioned with mechanical abrasion or a deionized (DI) water jet spray that can agitate (activate) the pad's surface and increase its roughness. An alternative approach to activate the pad's surface is to use a conditioning wheel ("disk") featuring a bottom diamond surface that contacts the pad while it rotates.

To maintain yield and quality of wafer polishing for volume manufacturing, it is desirable to continuously flow fresh slurry onto the polishing pad during the CMP process. And, for CMP processes that require a high removal rate, a higher flow rate of fresh slurry onto the polishing pad is required. It is therefore necessary to prepare a large quantity of fresh slurry to operate the polisher.

As the pad rotates to polish the wafers, a portion of fresh slurry reacts with the wafer's surface. This reaction creates by-products including strayed particles from the polishing pad and reactants between the slurry and wafers. The un-reacted fresh slurry, the abrasives, and the by-products become waste that is sprayed off the edge of the polishing pad and carried away by a drain. The constant supply of fresh slurry and resulting waste result in a significant manufacturing cost and overhead (e.g., environment pollution) to operate the polisher.

The present disclosure is directed to reduce manufacturing cost and overhead of operating the polisher by recycling slurry sprayed off the edge of the polishing pad. In some embodiments, a flotation module is fluidly connected to the polishing pad to collect a CMP waste sprayed from the polishing pad. In some embodiments, the flotation module includes chemicals, including a frother, a collector, and a modifier to react with the CMP waste to generate a recycled slurry. The recycled slurry from the flotation module can be delivered to the polisher, according to some embodiments.

FIG. 1 illustrates a CMP system 100 (thereafter "polisher 100"), according to some embodiments. Polisher 100 can include a polishing pad 102 (thereafter "pad 102") which is loaded on a rotating platen (e.g., a rotating table) 104. Polisher 100 can also include a rotating substrate carrier 106, a rotating conditioning wheel (or "disk") 108, a first slurry feeder 110 connected to a mixing tank 116 which mixes a fresh slurry, abrasives and DI water, and a second slurry feeder 118. For illustration purposes, FIG. 1 includes selected portions of polisher 100 and other portions (not shown) may be included, such as control units, transfer modules, pumps, drains, etc.

A substrate 112 to be polished is mounted face-down at the bottom of substrate carrier 106 so that the substrate's top surface contacts the top surface of pad 102. Substrate carrier 106 rotates substrate 112 and exerts pressure (e.g., a downforce) on it so that substrate 112 is pressed against rotating pad 102. A first fluid 114 and a second fluid 120 can be dispensed on the pad's surface, where first fluid 114 can be a mixture from mixing tank 116 and second fluid 120 can include a recycled slurry. Chemical reactions and mechanical abrasion between first fluid 114, second fluid 120, substrate 112, and pad 102 can result in material removal from the top surface of substrate 112.

The removed material are CMP by-products and are constantly sprayed off edge of pad 102 as a CMP waste 122. As a result, CMP waste 122 can further include the abrasives and an un-reacted slurry within first fluid 114 and second fluid 120. At the same time, conditioning wheel 108 can agitate the top surface of pad 102 to restore its roughness. However, this is not limiting and conditioning wheel 108 can condition pad 102 after substrate 112 has been polished and removed from polisher 100.

In some embodiments, polisher 100 can be configured to polish substrates with surfaces that include different types of materials, such as silicon, germanium, arsenic, nitrogen, oxygen, and metals.

In some embodiments, the slurry can be a mixture of chemicals that can include one or more abrasives, an oxidizer, a chelator, a surfactant, a corrosion inhibitor, a wetting agent, a removal rate enhancer, a biocide, a pH adjuster, and water. An ingredient of the slurry can be based on chemical components, such as silicon dioxide ($SiO_2$), aluminum oxide ($Al_2O_3$), cerium dioxide ($CeO_2$), carbon (C), silicon carbide (SiC), or titanium dioxide ($TiO_2$). Depending on the substrate polishing application, the one or more abrasives can include particles of $SiO_2$, $CeO_2$, $Al_2O_3$, zirconium oxide ($ZrO_2$), $TiO_2$, iron oxide ($Fe_2O_3$), zinc oxide (ZnO), or any other suitable material.

In some embodiments, the physical and mechanical properties of pad 102 (e.g., roughness, material selection, porosity, stiffness, etc.) can depend on the material to be removed from substrate 112. For example, copper polishing, copper barrier polishing, tungsten polishing, shallow trench isolation polishing, oxide polishing, or buff polishing require different type of pads in terms of materials, porosity, and stiffness. The pads used in a polisher, like polisher 100, should exhibit some rigidity to uniformly polish the substrate surface. Pads, like pad 102, can be a stack of soft and hard materials that can conform to some extent to the local topography of substrate 112. By way of example and not limitation, pad 102 can be thermoset or thermoplastic. Pad 102 can also include urethane or porous polymeric materials with a pore size between about 1 and about 500 μm.

Referring to FIG. 1, polisher 100 can further include a flotation module 124 to recycle slurry from CMP waste 122, where flotation module 124 can include an inlet 123 and an outlet 125. CMP waste 122 generated from substrate polishing is collected and introduced into inlet 123 of flotation module 124. CMP waste 122 reacts with chemicals in flotation module 124, where the chemicals can include a frother, a modifier, and a collector. In some embodiments, a flotation process within flotation module 124 removes most of CMP by-products and abrasives from CMP waste 122, and therefore extracts a recycled slurry from CMP waste 122. The recycled slurry is outputted at outlet 125 of flotation module 124 and is fluidly connected to second slurry feeder 118 as a source of second fluid 120. In some embodiments, flotation module 124 can include multiple inlets to receive CMP waste 122 and multiple outlets to output the recycled slurry.

In some embodiments, the recycled slurry from flotation module 124 is received by a filter module 126. Filter module 126 can include one or more filter elements to remove particles from the recycled slurry. For example, the one or more filter elements can be a resin or a filter paper to remove particles with a diameter larger than 0.5 μm. The filtered recycled slurry from filter module 126 can be received by a detection module 128 to examine chemical or physical properties of the filtered recycled slurry, which includes conductivity, chemical composition, chemical concentration, and/or a pH value of the filtered recycled slurry. Depending on the properties of the filtered recycle slurry, a control unit associated with polisher 100 (not shown in FIG. 1) regulates and manages the amount of filtered recycled slurry received by second slurry feeder 118 as a source of second fluid 120.

Figure 2:
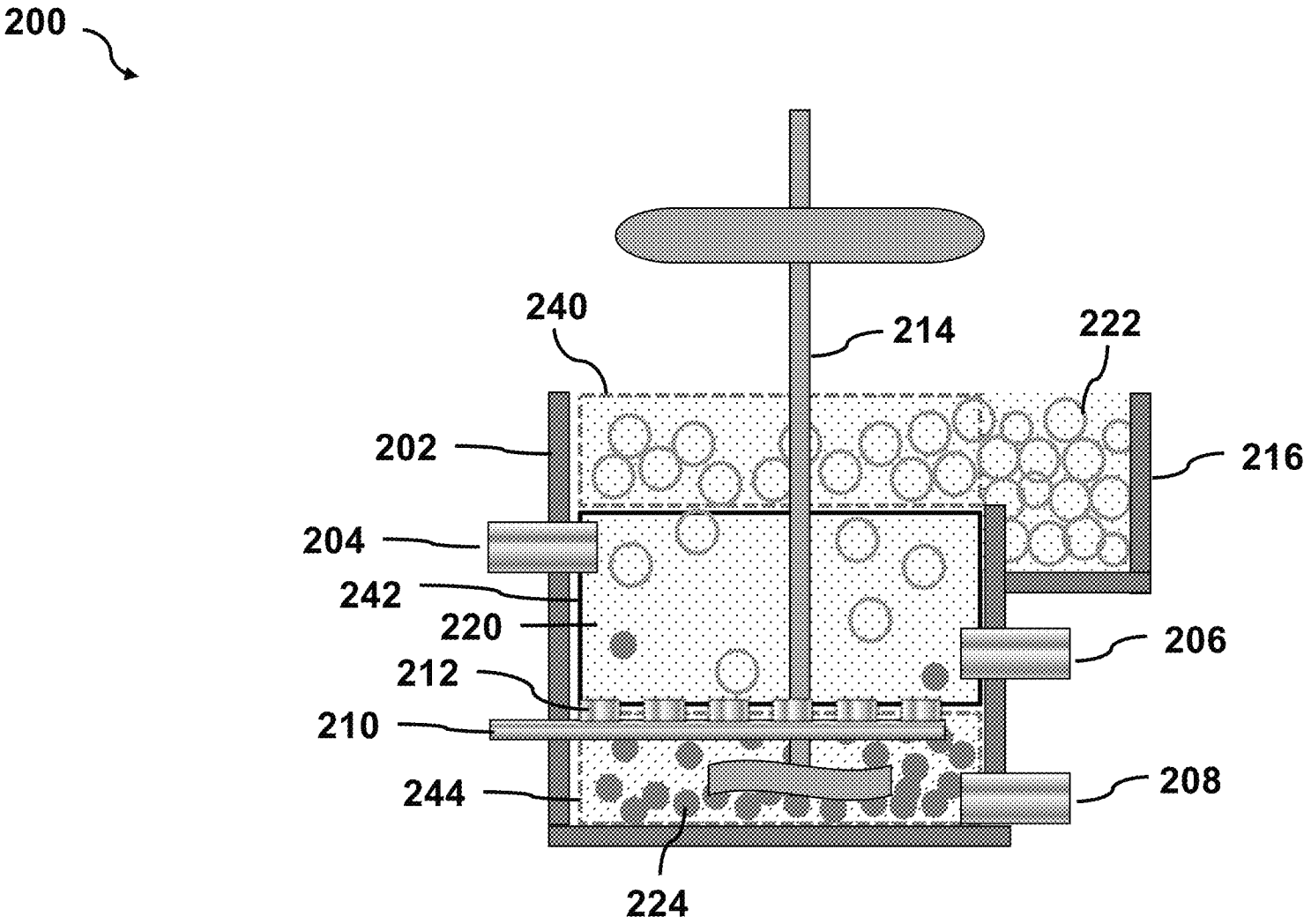
FIG. 2 illustrates a cross-sectional view of a flotation module, according to some embodiments.

FIG. 2 is an isometric view of a flotation module 200, according to some embodiments. Flotation module 200 can be an embodiment of flotation module 124 of FIG. 1. Flotation module 200 can include an agitator 214 and a first tank 202, where first tank 202 includes a chemical fluid 220. Chemical fluid 220 can include de-ionized (DI) water, a frother, a modifier, and/or a collector. First tank 202 can include a first inlet 204 to receive a CMP waste liquid containing slurry (e.g., CMP waste 122 from polisher 100), a first outlet 206 configured to output a recycled slurry from the CMP waste liquid, and a second outlet 208 fluidly connected to a drain (not shown in FIG. 2) of polisher 100. Flotation module 200 can further include a second tank 216 fluidly connected to an upper portion 240 of first tank 202. Second tank 216 can be fluidly connected to a drain (not shown in FIG. 2) to dispose chemical waste from first tank 202.

In some embodiments, first inlet 204 and first outlet 206 of FIG. 2 can be inlet 123 and outlet 125 of FIG. 1, respectively. In some embodiments, first outlet 206 and second outlet 208 can be located at a middle portion 242 and a bottom portion 244 of first tank 202, respectively. In some embodiments, first tank 202 can further include a second inlet 210 fluidly connected to a gas source (not shown in FIG. 2), where a gas (e.g., air or inert gas) from the gas source is dispensed into first tank 202 via gas dispensers 212. In some embodiments, second inlet 210 can be located at bottom portion 244 of first tank 202.

Referring to FIG. 2, flotation module 200 is configured to perform a flotation process to convert the CMP waste liquid containing slurry (e.g., CMP waste 122) to a recycled slurry. The CMP waste liquid generated from substrate polishing is collected and received by first tank 202 via first inlet 204. In first tank 202, a portion of CMP by-products with heavy weight contained in the CMP waste liquid can start to sink and form precipitations 224 at bottom portion 244 of first tank 202. Precipitations 224 are discarded towards a drain of polisher 100 via second outlet 208. At the same time, agitator 214 is configured to agitate chemical fluid 220 and the CMP waste liquid in first tank 202. Such agitation process facilitates the frother to form bubbles in first tank 202. In some embodiments, the gas introduced via second inlet 210 can be another source to promote the frother to form bubbles. The bubbles contain air or gas and therefore have a tendency to float towards upper portion 240 of first tank 202.

Abrasives and another portion of CMP by-products in the waste liquid react with the modifier and the collector to form intermediate molecules. The intermediate molecules further bond with the bubbles to form agglomerations 222. With the buoyancy of the bubbles, a majority of agglomerations 222 float toward upper portion 240 of first tank 202. A portion of agglomerations 222 further drift or diffuse to second tank 216 and are expelled to a drain (not shown at FIG. 2) fluidly connected to second tank 216. As a result, a majority portion of the CMP waste (e.g., abrasives and CMP by-products) is removed from the CMP waste liquid by both precipitations 224 sinking down and agglomerations 222 floating up. Thus, the CMP waste liquid at middle portion 242 of first tank 202 includes less abrasives and CMP by-products and can be outputted as a recycled slurry via first outlet 206 of flotation module 200.

In some embodiments, agitator 204 can include a fan in chemical fluid 220 and a bearing supporting the fan. The bearing can be coupled to a motion mechanism (not shown in FIG. 2), such as pump or a motor, to rotate the fan. In some embodiments, agitator 204 can be an ultrasonic device or an oscillator device to facilitate the frother in first tank 202 to form bubbles.

In some embodiments, flotation module 200 can further include a heating device to control a temperature of chemical fluid 220 in first tank 202. In some embodiments, the flotation process occurs at or above room temperature (e.g., 25° C.).

Figure 3:
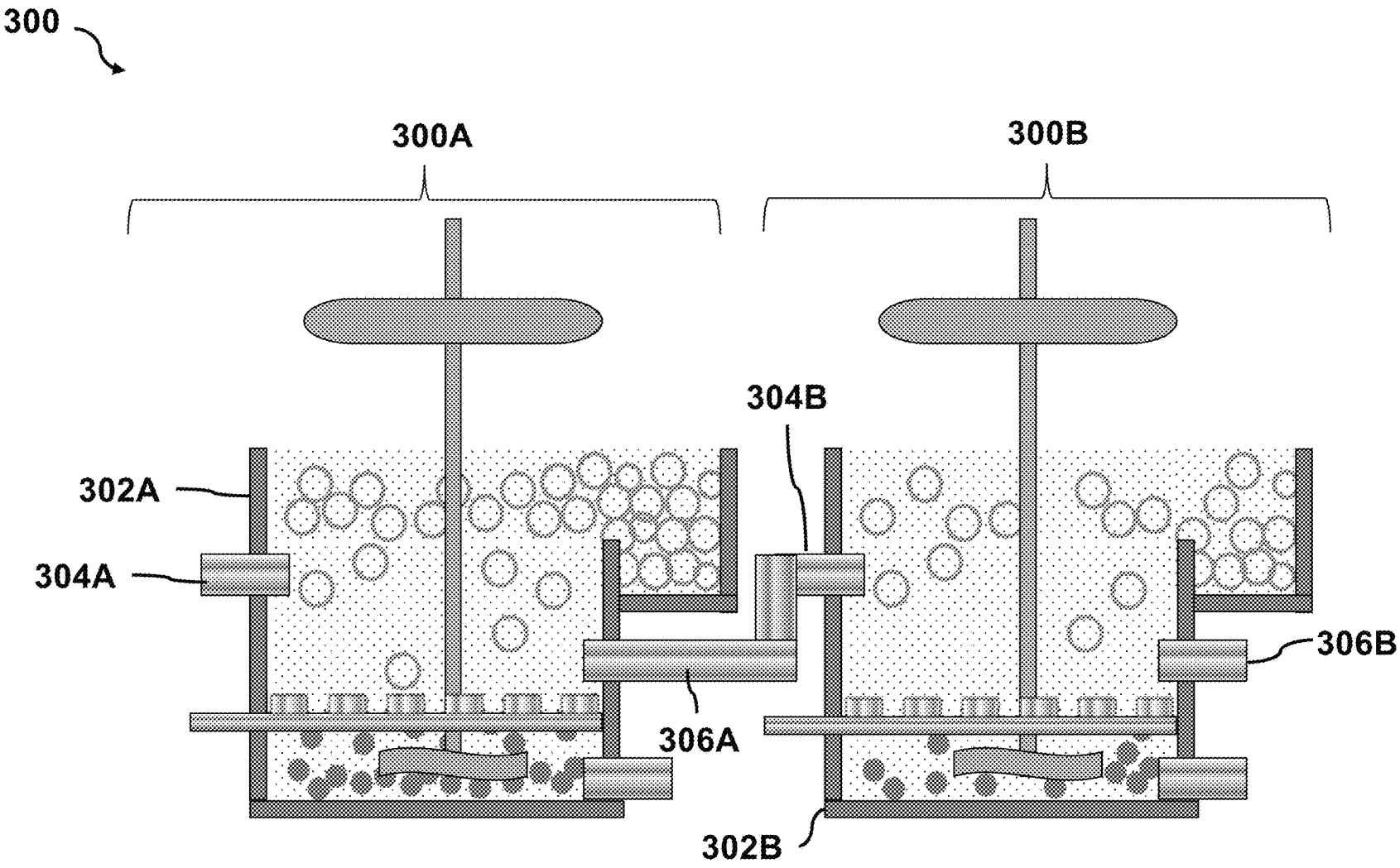
FIG. 3 illustrates a cross-sectional view of another flotation module, according to some embodiments.

FIG. 3 is a isometric view of a flotation module 300, according to some embodiments. Flotation module 300 can be an embodiment of flotation module 124 in FIG. 1. As shown in FIG. 3, flotation module 300 can include a flotation module 300A fluidly connected to another flotation module 300B, where an outlet 306A of flotation module 300A is fluidly connected to an inlet 304B of flotation module 300B. Both flotation module 300A and 300B have similar configurations and functionality as flotation module 200. A CMP waste liquid containing slurry (e.g., CMP waste 122) is received by flotation module 300A via an inlet 304A. A first recycled slurry from outlet 306A of flotation module 300A enters flotation module 300B via an inlet 304B. The final recycled slurry is outputted from flotation module 300B via an outlet 306B. The flotation process described above with respect to FIG. 2 can be performed by each of flotation modules 300A and 300B. As a result, the final recycled slurry from flotation module 300B includes less CMP waste than the first recycled slurry. In some embodiments, flotation module 300 can fluidly connect more than two flotation modules 200 in series to output a recycled slurry with improved purity.

Figure 4A:
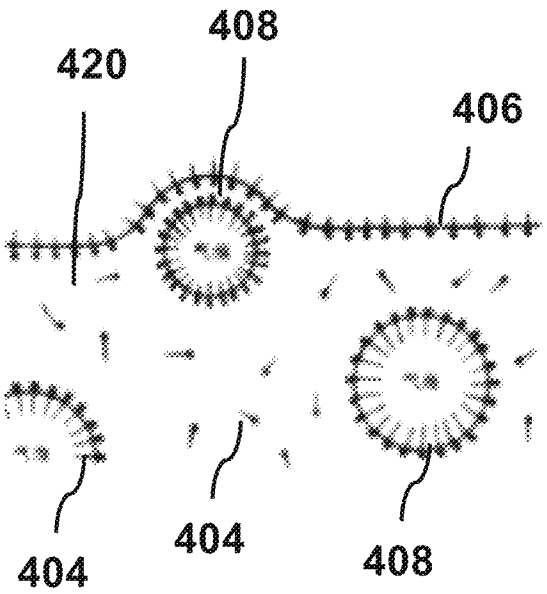
FIGS. 4A-4C illustrate a flotation process in a flotation module, according to some embodiments.
Figure 4B:
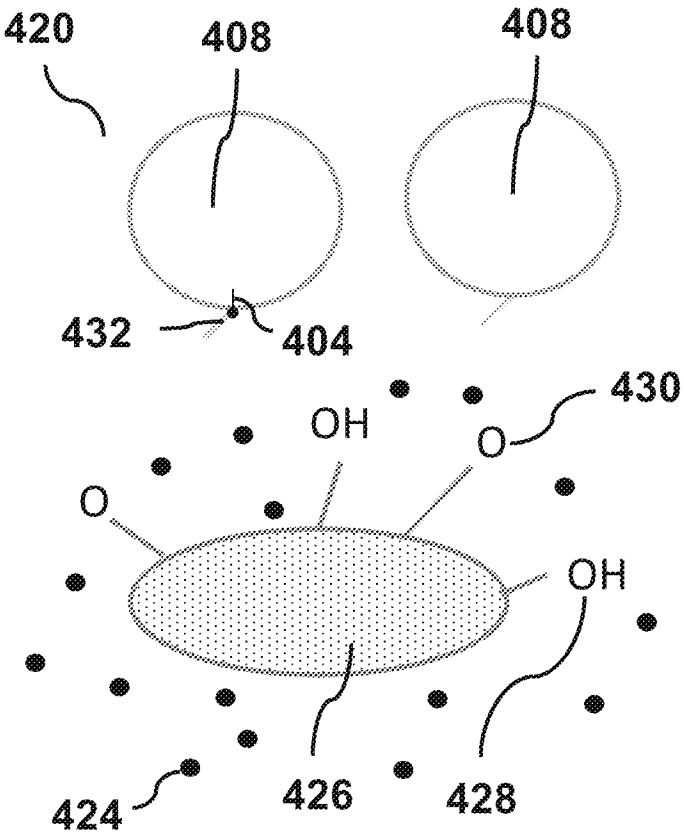
Figure 4C:
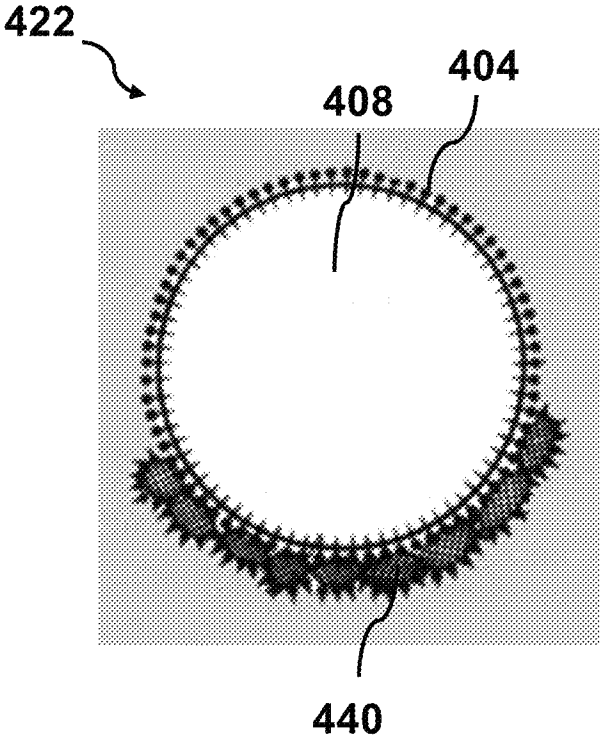

FIGS. 4A-4C illustrate details of the flotation process described above with respect to flotation modules 200 and 300, according to some embodiments. The flotation process converts a CMP waste fluid (e.g., CMP waste 122) to a recycled slurry. The flotation process can include a frothing process, an adjustment process, and a collecting process.

FIG. 4A shows the frothing process performed by a frother 404 scattered within a chemical liquid 420, where chemical liquid 420 can be similar to chemical fluid 220 described above. Frother 404 can be a molecule which has a polar and a nonpolar bond. The polar bond attracts water molecules in chemical liquid 420 and causes frother 404 to gather at a surface level 406 of chemical liquid 420. When introducing a non-dissolvable gas (e.g., air or inert gas) into chemical liquid 420 (e.g., by agitator 214 in flotation module 200), a portion of frother 404 can start to froth and form bubbles 408 in chemical liquid 420. For each bubble 408, frother 404 can accumulate at the boundary of each bubble 408, where the polar bond and nonpolar bond of each frother 404 faces outward and inward of each bubble 408, respectively. Each bubble 408 contains the non-dissolvable gas and therefore has buoyance to float upward in chemical liquid 420.

In some embodiments, frother 404 can be alcohol ($C_5H_{11}OH$), phenol ($C_6H_5OH$), or wood oil including pinene ($C_{10}H_{16}$), terpineol ($C_{10}H_{17}OH$), citronellal ($C_{10}H_{18}O$), or any other suitable material. In some embodiments, frother 404 can be an organic or an inorganic material.

FIG. 4B shows the adjustment and the collecting processes performed by collectors 432 and modifiers 424, respectively. The collecting process can be configured to bind abrasives or CMP by-products from the CMP waste to bubbles 408. In the collecting process, chemical bonds of collectors 432 can connect with frothers 404 located at a boundary of bubble 408, while other chemical bonds of collectors 432 can tie to the abrasives or CMP by-products. The adjustment process can be configured to alter a hydrophobicity or hydrophilicity property of the abrasives or CMP by-products via modifier 424. In referring to FIG. 4B, molecules 426 can be an abrasive in a slurry used by a polisher (e.g., polisher 100). Molecules 426 can also be a CMP by-product, such as a chemical reactant or a removed material generated by polishing substrates. As a result, molecules 426 can include silicon, silicon hydroxide ($Si(OH)_4$), germanium, arsenic, metal ions such as copper, tungsten, aluminum, cobalt, ruthenium, titanium, cerium, or any other materials. Molecules 426 can have a property of hydrophilicity, where each molecule 426 may have one or more OH-bonds 428. Molecules 426 therefore have favorable interactions with surrounding water molecules, such as forming polar bonding in between. As a result, molecules 426 tie to surrounding water molecules and are difficult to be moved away from its local position in chemical liquid 420. Modifiers 424 can be applied to release such tight binding by converting molecules 426 from a property of hydrophilicity (e.g., in favor to bond with water) to hydrophobicity (e.g., against a bond with water). With less attraction to the surrounding water molecules, the converted molecules are easier to be captured by collector 432. Therefore, the modifying process via modifier 424 can improve an efficiency of the collecting process via collector 422.

In some embodiments, the collecting process can also include tying molecule 426 to collector 432 via one or more oxygen bonds 430 included in molecule 426.

In some embodiments, collector 432 can be a molecule that forms a bond with frother 404. In some embodiments, collector 432 can be a molecule that bonds with one or more oxygen bonds 430 from molecule 426, where molecule 426 is from CMP waste. In some embodiments, collector 432 can be a fatty acid or a soap with a molecular structure that includes R-COOH, or R-COO-M, where R represents a chain of hydrocarbon (e.g., $C_nH_{2n+}$) and M represents metal (e.g., sodium (Na), potassium (K), or any other metal elements). In some embodiments, collector 432 can be sodium dithiophosphate ($Na_3PS_2O_2$) or ethyl amine ($NC_2C_2H_5$). In some embodiments, collector 432 can be an organic or an inorganic material.

In some embodiments, modifier 424 can be a pH adjuster, such as sodium carbonate ($Na_2CO_3$), sodium hydroxide (NaOH), or any other suitable material. In some embodiments, modifier 424 can be a dispersant, such as sodium silicate ($Na_2SiO_3$), a molecule containing molecular structure of phosphate ($PO_3^-$), or any other suitable material. In some embodiments, modifier 424 can be an agglomerant, such as potassium alum ($KAl(SO_4)_2.12H_2O$) or any other suitable material. In some embodiments, modifier 424 can be an inhibitor, such as sodium mercaptoacetate ($HSCH_2COONa$) or any other suitable material. In some embodiments, modifier 424 can be an activator, such as sodium carbonate or any other suitable material. In some embodiments, modifier 424 can be an organic or an inorganic material.

FIG. 4C shows an exemplary agglomeration 422 formed by the flotation process. Agglomeration 422 is similar to agglomeration 222 described above. During the flotation process, the hydrophilicity or hydrophobicity property of molecules 426 is modified by the adjustment process via modifiers 424. One or more collectors 432 then capture and bind modified molecules 426 to bubble 408 created by the frothing process via frother 404. As a result, agglomeration 422 is formed and is an assembly of bubble 408 connecting with intermediate molecules 440, where each intermediate molecule 440 includes modified molecules 426 fastening together with collectors 432. Since bubble 408 tends to float up in chemical liquid 420, agglomeration 422 has tendency to move toward a surface level of chemical liquid 420. As a result, molecules 426 (e.g., CMP waste) can be moved away by agglomerations 422 and are collected near the surface level of chemical liquid 420 by the flotation process.

Figure 5:
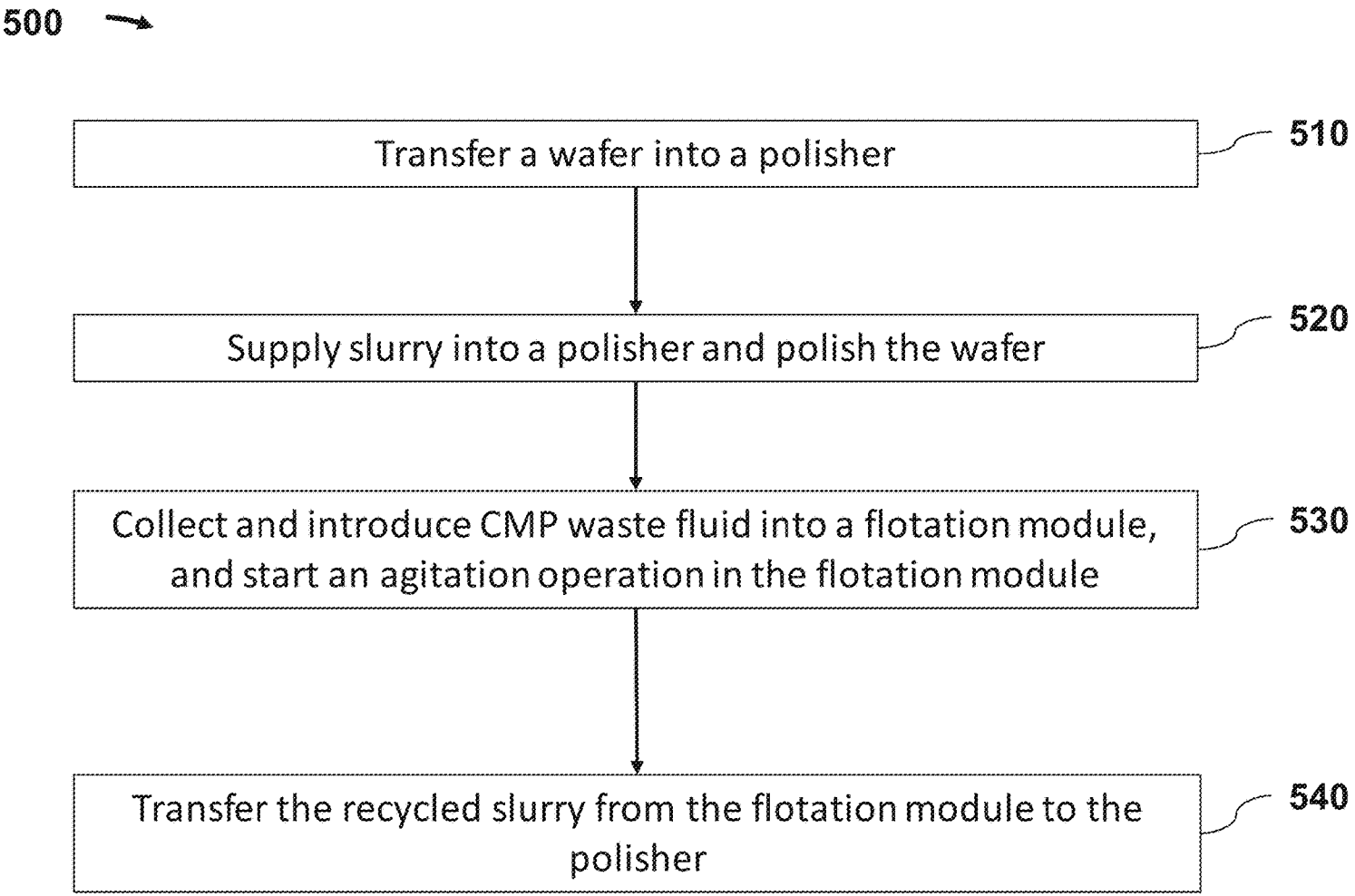
FIG. 5 illustrates a method for recycling slurry for a polishing tool, according to some embodiments.

FIG. 5 is an exemplary method 500 for operating a polisher using a recycled slurry where the recycled slurry is recycled from a CMP waste generated by a polishing process, according to some embodiments. This disclosure is not limited to this operational description. It is to be appreciated that additional operations may be performed. Moreover, not all operations may be needed to perform the disclosure provided herein. Further, some of the operations may be performed simultaneously or in a different order than shown in FIG. 5. In some implementations, one or more other operations may be performed in addition to or in place of the presently described operations. For illustrative purposes, method 500 is described with reference to the embodiments of FIGS. 1-4. However, method 500 is not limited to these embodiments.

Exemplary method 500 begins with operation 510, where a substrate is transferred into a polisher. Referring to FIG. 1, for example, substrate 112 can be transferred into polisher 100 and placed under substrate carrier 106 so that the side of the substrate to be polished is facing polishing pad 102. In other words, the top surface of substrate 112 can be positioned against the top surface of pad 102. Substrate 112 can be transferred into polisher 100, for example, from a transfer module with the help of a robotic arm, which is not shown in FIG. 1 merely for simplicity.

In referring to FIG. 5, in operation 520, substrate 112 is polished. Referring to FIG. 1, the polishing operation can include dispensing a slurry 114 and a recycled slurry 120 through a first slurry feeder 110 and a second slurry feeder 118 over pad 102 and subsequently rotating substrate carrier 106 and pad 102 (e.g., through platen 104). In some embodiments, substrate carrier 106 and pad 102 can rotate in the same direction; however, their respective rotational speeds, or angular speeds, can be different. During operation 520, a CMP waste 122 is generated and sprayed off edge of pad 102, where CMP waste 122 can include un-reacted slurry, abrasives, and CMP by-products that include reactants and removed material caused by polishing substrate 112.

In operation 530, CMP waste 122 is collected and introduced to a flotation module, where the flotation module initiates a flotation procedure to convert the CMP waste fluid to a recycled slurry. Referring to FIGS. 1 and 2, for example, CMP waste 122 can be received by inlet 204 of flotation module 200 by a pump associated with polisher 100. At the same time, agitator 214 can initiate an agitation process to mix CMP waste 122 with chemicals in flotation module 200, where the chemicals can include a frother, a modifier and a collector. The agitation process triggers frother to form bubbles. In some embodiments, a gas can be introduced into flotation module 200 to promote the frother to form the bubbles. Modifiers can be used to alter the hydrophobicity or hydrophilicity property of abrasives and CMP by-products in CMP waste 122. This can enhance the efficiency of collectors to tie the abrasives and the CMP by-products together with the bubbles to form agglomerations 222 in flotation module 200. With the buoyance of the bubbles, such agglomerations 222 have tendency to float toward an upper portion of flotation module 200. In other words, a majority of abrasives and CMP by-products are carried away by agglomerations 222 and transported toward the upper portion of flotation module 200. As a result, CMP waste 122 located at the middle portion of flotation module 200 has a purer slurry and can therefore be used as recycled slurry.

In some embodiments, the floatation module can further include a heater device to provide heat to facilitate the flotation procedure.

In some embodiments, the flotation module can be configured to recycle slurry from CMP waste fluid from a variety of CMP processes, including CMP processes for metals, dielectrics, and other materials. Additionally, the flotation module can be used to recycle slurry from CMP waste fluid from CMP processes employed in different areas of chip manufacturing, such as front end of the line (FEOL), middle of the line (MOL), and back end of the line (BEOL). Further, the flotation module can be used to recycle slurry from CMP waste fluid from a CMP process for any technology area that includes the CMP process.

In operation 540, the recycled slurry from outlet 206 of FIG. 2 is received by slurry feeder 118 of FIG. 1 using a pump associated with polisher 100. The recycled slurry dispensed by slurry dispenser 118 can be mixed with a fresh slurry dispensed by slurry feeder 110 on pad 102 for polishing substrate 112. A ratio between the recycled slurry and the fresh slurry dispensed on pad 102 can be controlled by a control unit associated with polisher 100. In some embodiments, the control unit can manage operations of flotation module 200 and determine and regulate an output flux or quantity of the recycled slurry.

In some embodiments, after outputting the recycled slurry from flotation module 200, the recycled slurry can be received by filter module 126 shown in FIG. 1. Filter module 126 can be equipped with one or more filtering elements to remove particles from the recycled slurry. For example, filter module 126 can be configured to remove particles larger than 0.5 μm in diameter. The recycled slurry with reduced particles can provide reliable polishing for substrate 112 on pad 102.

In some embodiments, the recycled slurry from filter module 126 can be received by a detection module 128 shown in FIG. 1. The detection module is configured to examine properties of the recycled slurry, which can include conductivity, pH value, purity, and chemical composition. This information can be sent to a control unit associated with polisher 100, where the control unit regulates a flux of the recycled slurry to slurry dispenser 118 based on the information.

The present disclosure provides an apparatus and a method for a CMP process that recycles used slurry as other source of slurry supply. According to some embodiments, the apparatus can include a flotation module to recycle the used slurry, which contains a CMP waste. In some embodiments, the flotation module can include chemicals to conduct a flotation process to separate the CMP waste from the used slurry, where the chemicals can include a frother, a collector, and a modifier. The flotation process can include forming bubbles via the frother, modifying a hydrophobicity or hydrophilicity property of the CMP waste via the modifier, and bonding the modified CMP waste with the bubbles via the collector. Such polishing apparatus equipped with the flotation module can cut amount of slurry consumption, thus reducing manufacturing cost and overhead of operating the polishing apparatus.

In some embodiments, a polishing system includes a pad on a rotation platen, a first feeder and a second feeder where each of the first and the second feeder is configured to dispense a slurry on the pad, and a flotation module configured to process a first fluid sprayed from the pad. The flotation module further includes an outlet fluidly connected to the second feeder and configured to output a second fluid, and a first tank configured to store a plurality of chemicals where the plurality of chemicals include a frother and a collector configured to chemically bond with chemicals in the first fluid.

In some embodiments, a flotation module includes a tank configured to store a first fluid including a frother, and an agitator configured to cause the frother to create bubbles in the first fluid in the tank. The tank further includes an inlet configured to provide a second fluid to the tank, a first outlet configured to output a recycled slurry, and a second outlet fluidly connect to a drain.

In some embodiments, a method for operating a chemical mechanical planarization (CMP) system includes supplying a first fluid and a second fluid where the first fluid includes a slurry, polishing a substrate with the first and the second fluids, collecting, by a flotation module, a third fluid where the third fluid is created by polishing the substrate, and extracting a fourth fluid from the third fluid where the fourth fluid is fluidly connected to a source of the second fluid.

It is to be appreciated that the Detailed Description section, and not the Abstract of the Disclosure section, is intended to be used to interpret the claims. The Abstract of the Disclosure section may set forth one or more but not all possible embodiments of the present disclosure as contemplated by the inventor(s), and thus, are not intended to limit the subjoined claims in any way.

The foregoing disclosure outlines features of several embodiments so that those skilled in the art may better understand the aspects of the present disclosure. Those skilled in the art will appreciate that they may readily use the present disclosure as a basis for designing or modifying other processes and structures for carrying out the same purposes and/or achieving the same advantages of the embodiments introduced herein. Those skilled in the art will also realize that such equivalent constructions do not depart from the spirit and scope of the present disclosure, and that they may make various changes, substitutions, and alterations herein without departing from the spirit and scope of the present disclosure.

What is claimed is:

1. A polishing system, comprising:

a pad on a rotating platen;

a first feeder and a second feeder, wherein each feeder of the first and second feeders is configured to dispense an abrasive-containing slurry on the pad; and a flotation module configured to process a first fluid generated from the pad, wherein the flotation module comprises:

an outlet fluidly connected to the second feeder and configured to output a second fluid;

a tank configured to store a plurality of chemicals, wherein the plurality of chemicals comprise a frother and a collector configured to chemically bond with chemicals in the first fluid; and an inlet comprising one or more gas dispensers configured to be immersed in the first fluid in the tank.

2. The polishing system of claim 1, further comprising a filter module fluidly connected between the second feeder and the outlet and configured to remove particles from the second fluid.

3. The polishing system of claim 1, further comprising a detection module fluidly connected between the outlet and the second feeder and configured to examine chemical and physical properties of the second fluid.

4. The polishing system of claim 1, wherein the tank further comprises an other inlet and an other outlet, wherein the other inlet is configured to receive the first fluid and the other outlet is fluidly connected to a drain.

5. The polishing system of claim 1, wherein the flotation module further comprises an other tank fluidly connected to an upper portion of the tank.

6. The polishing system of claim 1, wherein the plurality of chemicals further comprise a modifier configured to change a hydrophobicity and hydrophilicity of one or more molecules in the first fluid.

7. The polishing system of claim 1, further comprising an other flotation module wherein the outlet of the flotation module is fluidly connected to a tank of the other flotation module.

8. The polishing system of claim 1, further comprising a mixing tank that stores the abrasive-containing slurry dispensed to the first feeder, wherein an outlet of the mixing tank is fluidly connected to the first feeder.

9. The polishing system of claim 1, further comprising a substrate carrier configured to hold a substrate against the pad and apply a pressure to the substrate.

10. A polishing system, comprising:

a first feeder configured to supply a fresh abrasive-containing slurry to a pad;

a substrate carrier configured to hold a substrate against the pad; and a flotation module, comprising:

a tank configured to store a fluid comprising a frother, wherein the tank comprises:

an inlet configured to provide a slurry waste to the tank;

an other inlet comprising one or more gas dispensers configured to be immersed in the fluid in the tank;

a first outlet configured to output a recycled slurry to a second feeder of the polishing system; and a second outlet fluidly connected to a drain; and an agitator configured to cause the frother to create bubbles in the fluid in the tank.

11. The polishing system of claim 10, further comprising a filter module configured to remove particles from the recycled slurry, wherein the first outlet is fluidly connected to the filter module.

12. The polishing system of claim 10, wherein the fluid further comprises:

a collector configured to bond with one or more chemicals in the slurry waste; and a modifier configured to alter a hydrophobicity and hydrophilicity of the one or more chemicals in the slurry waste.

13. The polishing system of claim 12, wherein:

the frother comprises alcohol ($C_5H_{11}OH$), phenol ($C_6H_5OH$), wood oil comprising pinene ($C_{10}H_{16}$), terpineol ($C_{10}H_{17}OH$), citronellal ($C_{10}H_{18}O$), an inorganic material, and combinations thereof;

the collector comprises a soap with a molecular structure that comprises R-COOH and R-COO-M, wherein R represents a chain of hydrocarbon and M represents a metal, sodium dithiophosphate ($Na_3PS_2O_2$), ethyl amine ($NC_2C_2H_5$), a fatty acid, and combinations thereof; and the modifier comprises a pH adjuster, a dispersant, a molecule comprising phosphate ($PO_3^-$), an agglomerant, an inhibitor, an activator, an inorganic material, and combinations thereof.

14. The polishing system of claim 10, wherein the agitator comprises a fan supported by a bearing, an ultrasonic device, an oscillator device, and combinations thereof.

15. The polishing system of claim 10, wherein the one or more gas dispensers are configured to provide gas into the tank, and wherein the gas causes the frother to create bubbles in the fluid in the tank.

16. A polishing system, comprising:

a first feeder configured to supply a fresh abrasive-containing slurry to a pad;

a second feeder configured to supply a recycled slurry to the pad;

a substrate carrier configured to hold a substrate against the pad;

a first flotation module configured to receive a slurry waste from the pad and convert the slurry waste to an intermediate recycled slurry; and a second flotation module configured to receive the intermediate recycled slurry and convert the intermediate recycled slurry to the recycled slurry, wherein each flotation module of the first and second flotation modules comprises an inlet comprising one or more gas dispensers configured to be immersed in the slurry waste and the intermediate recycled slurry, respectively.

17. The polishing system of claim 16, further comprising:

a filter module configured to receive the recycled slurry and remove particles in the recycled slurry; and a detection module configured to inspect chemical and physical properties of the recycled slurry.

18. The polishing system of claim 16, wherein each flotation module of the first and second flotation modules comprises an agitator configured to cause a frother to create bubbles in the first and second flotation modules, and wherein the agitator comprises a fan supported by a bearing, an ultrasonic device, an oscillator device, and combinations thereof.

19. The polishing system of claim 16, wherein the one or more gas dispensers are configured to provide gas into the first and second flotation modules, and wherein the gas causes a frother to create bubbles in the first and second flotation modules.

20. The polishing system of claim 10, wherein the other inlet comprising the one or more gas dispensers is separate from the agitator.

* * * * *